United States Patent [19]

Mattson

[11] Patent Number: 4,967,645

[45] Date of Patent: Nov. 6, 1990

[54] AIR SHOWER WITH DIRECTED AIR FLOW

[75] Inventor: Brian Mattson, Boise, Id.

[73] Assignee: Micron Technology, Inc., Boise, Id.

[21] Appl. No.: 441,610

[22] Filed: Nov. 27, 1989

[51] Int. Cl.[5] ..... F24F 9/00

[52] U.S. Cl. ..... 98/31.5; 15/316.1; 98/31.6; 98/33.1; 98/34.6; 98/36

[58] Field of Search ..... 15/316 R, 40 S, 415 R; 98/1, 31.5, 31.6, 33.1, 34.5, 34.6, 40.02, 40.18

[56] References Cited

U.S. PATENT DOCUMENTS

| | | | |
|---|---|---|---|
| 2,672,806 | 3/1954 | Vehige | 98/1 |
| 4,581,986 | 4/1986 | Conklin et al. | 98/1 |
| 4,624,690 | 11/1986 | Byrnes | 15/316 R X |
| 4,790,080 | 12/1988 | Detzer et al. | 98/36 X |

FOREIGN PATENT DOCUMENTS

| | | | |
|---|---|---|---|
| 131636 | 10/1980 | Japan | 98/34.5 |

*Primary Examiner*—Harold Joyce

*Attorney, Agent, or Firm*—Stanley N. Protigal; Angus C. Fox, III

[57] ABSTRACT

A cleanroom facility is provided with an air shower in which gasper jets are used to direct air in a preferred manner against persons entering the cleanroom facility. The gasper jets are combined with a downward air flow and with air curtains which limit the escape of dust particles from the air shower to remaining portions of the cleanroom facility. Primary and secondary air showers are provided to first remove excess particles from the person's street clothes, and then remove any loose particles which may be on the person's cleanroom clothing. A third air shower is provided as a separate secondary air shower for a second cleanroom facility area.

11 Claims, 3 Drawing Sheets

AIR SHOWER WITH DIRECTED AIR FLOW

BACKGROUND OF THE INVENTION

1. Field of the Invention

This invention relates to air handling equipment used to evacuate dust particles from cleanroom environment. More specifically, the invention relates to an air shower used to "rinse" or blow loose particles from a person entering the cleanroom environment.

2. Background of the Invention

Cleanrooms are manufacturing facilities which have reduced contamination, particularly from dust particles. Clean rooms have different degrees of cleanliness, ranging from Class 100 to Class 100,000, as measured by U.S. Federal Standard 209b. The establishment of higher cleanliness levels (lower class numbers) is accomplished by high efficiency air particulate (HEPA) filters.

Through a series of filtration and air flow control steps, dust particles are reduced from a typical ambient level of class one million (one million particles of one micron or larger per cubic foot) to levels which are from class one thousand (one thousand particles per cubic foot) and higher, down to class ten and lower. The cleanrooms from which this invention was developed are semiconductor fabrication facilities.

Apparatus of the general type with which this invention is concerned are used in conjunction with clean rooms such as semiconductor and pharmaceutical fabrication rooms, hospital operating rooms, and other rooms where it is important to provide an environment which is very low in particulates such as dirt, dust, skin cells and bacteria. In such rooms, workers often wear gloves and booties to prevent such particulates on their hands and feet from contaminating objects which the worker touches and to prevent such particulates from being shaken into the air from their hands and feet and randomly contaminating other objects in the room.

The semiconductor fabrication facility for which this invention was developed is a class one or zero cleanroom. The class one cleanroom atmosphere is maintained without the requirement that people in the cleanroom wear special breathing apparatus, although special clothing is required In this type of cleanroom, a person entering the cleanroom would first pass a shoe-cleaning station and a sticky mat, and then enter a "bootie room." In that room, a person puts on shoe coverings ("booties") and a hair net. The person then passes through a first air shower and puts on the remaining cleanroom garments, including overalls, underhood, and gloves At that location, as well as in the bootie room and in other locations of the cleanroom facility, clean air is directed in a substantially vertical flow from the ceiling to , grates in the floor used for return air. The substantial portions of the cleanroom facility floor are grids which form the return air. By providing the vertical flow of air from the ceiling to the floor, dust particles which occur in the cleanroom facility are quickly drawn down through the return air. Other particle control techniques include a slight pressurization of the cleanroom facility in order that a door or other opening does not bring contaminated air into the cleanroom facility.

The air shower is used to remove loose particles from a person's skin and clothing prior to the person further entering the cleanroom facility. The air shower must perform two functions: first, the air shower must remove any loose particles from the user by blowing the particles from the user. Secondly, the air shower must evacuate or exhaust the particles which are generated by this process. For this reason, the air shower, while being turbulent, must also have a continuously directed air flow which is capable of exhausting particles removed by the turbulent action of the air shower. Air showers are used to remove particulates from gloved or ungloved hands, clad or unclad feet, hoods, jumpsuits, streetclothes, wipes and other objects by use of air streams. Ideally, air showers also prevent the removed particulates from re-entering the surrounding environment by trapping them (the particulates) in a filtration system.

Air showers generate different levels of comfort with different people, much as different individual dogs react differently to vacuum cleaners. In designing an air shower, we must be concerned with the maximum airflow tolerated by those who find the air shower least relaxing. Specifically, we desire that a maximum cleaning efficiency be achieved at a pleasant comfort level. We expect that a higher maximum airflow along a short length of corridor may be as pleasant as a lower maximum airflow along a longer length of corridor.

In the prior art, turbulent flow clean room systems were avoided in favor of clean room systems employing vertical laminar flow systems. Vertical laminar flow system clean room have planer inlet ports in the ceiling and outlet grates in the floor. Turbulent flow air showers, on the other hand, are very effective in removing loose particulates.

One type of air shower uses apertures which take the form of a pair of coplanar slots located in opposing walls, and extend vertically from a point approximately 0.5 meters high to a point approximately 1.5 meters high. To correctly utilize this type of air shower, a worker opens the entrance door, enters the shower room, positions himself or herself between the slots, raises his or her arms and turns in a complete circle. The blower forces a stream of generally laminar medium velocity air through each slot, into the shower room and against the person to dislodge particles from the person's body. Some of the particulates are immediately entrained in the return flow of air and drawn through the floor and the filter, and other of the dislodged particulates float into the air within the shower room, are contained by the walls and ceiling of the shower room and most are eventually entrained in the return flow of air and filtered. Some of these other particulates may escape from the shower room when the worker exits. An air curtain is provided to block the dislodged particulates so that the dislodged particulates do not enter the surrounding environment. Consequently, such a device is usually installed outside of a clean room. The air curtains occur as a natural effect of the air flow patterns which occur in various portions of the clean room, and usually are not specially installed.

Another similar type of air shower uses a group of nozzles located on the ceiling and walls of the associated shower room instead of the vertical slots to direct streams of air against a user.

The process of utilizing the air showers of the types described above, from the time the user opens the entrance door to the time the worker exits the shower room, usually requires 30 seconds or more and is inconvenient.

It is a general aim of the invention to provide a cleaning apparatus of the foregoing type which removes the particulates quickly with minimal inconvenience to the user. At the same time it is desired to prepare the user for entrance into the clean room by putting the user in a proper state of mind.

SUMMARY OF THE INVENTION

In accordance with the present invention, a cleanroom facility is provided with an air shower in which gasper jets are used to direct air in a preferred manner against persons entering the cleanroom facility. The gasper jets are combined with a downward air flow and with air curtains which limit the escape of dust particles from the air shower to remaining portions of the cleanroom facility.

The clean room according to the invention can be suitably applied to fields requiring the clean zones having a high degree of cleanliness, for example, IC production, biochemistry, fine chemical production, medical treatment, assembly of precision machinery, etc.

In a preferred embodiment of the invention, primary and secondary air showers are provided. This provides the air shower effect on persons entering a final dress-up area, and provides a further air shower effect on persons leaving the final dress-up area to go into the main part of the cleanroom facility. In this manner, the first air shower is used to first remove excess particles from the person's street clothes, and the second air shower is used to remove any loose particles which may be on the person's cleanroom clothing.

The air showers provide high air velocity air with full vertical laminar flow. A descending density, along the length of the air shower, of gasper nozzles results in increased particle removal with a minimum of generation of new particles.

A third air shower is provided as a separate secondary air shower for a second cleanroom facility area. In that way, the first air shower is used for both cleanroom facilities, and common dressing rooms are used, but the final air showers are separate.

DETAILED DESCRIPTION OF THE PREFERRED EMBODIMENTS

Figure 1:
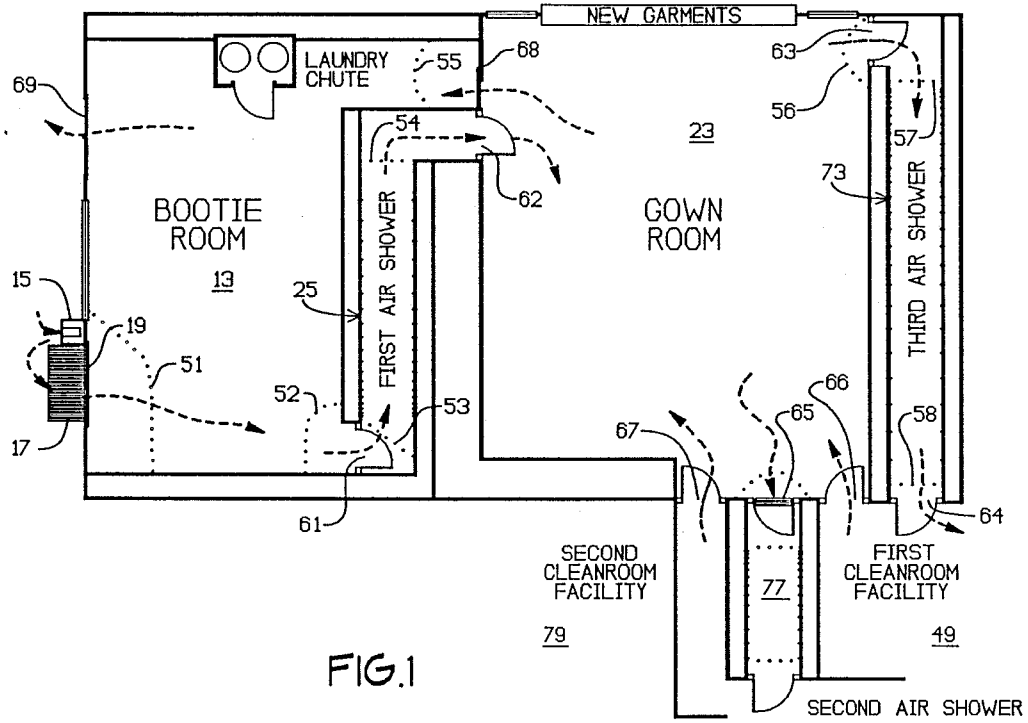
FIG. 1 shows a generalized layout of a cleanroom facility constructed in accordance with the present invention.

Referring to FIG. 1, a cleanroom facility is entered through a bootie room 13 after the person passes a shoe-cleaning station. The shoe-cleaning station includes a vacuum and brush arrangement 15 and a sticky mat 17 which is placed in front of an entrance door 19 of the bootie room 13. The bootie room 13, like most areas of the cleanroom facility, have grids on the floor and ceiling which permit air to flow continuously from ceiling to floor, thereby carrying dust particles which would otherwise tend to float about the room.

Dust particles are generally heavier than air, like bird feathers. Also, like bird feathers, air currents are readily able to move the dust particles about. Without electrostatic charges, the dust particles will eventually settle downward or drift out of the area, so that a slight downward air draft will result in the dust particles being directed downward and evacuated through the floor grates.

After the person enters the bootie room 13, she puts on booties and a hair net and enters a gown room 23 by passing through a first air shower 25.

Figure 2:
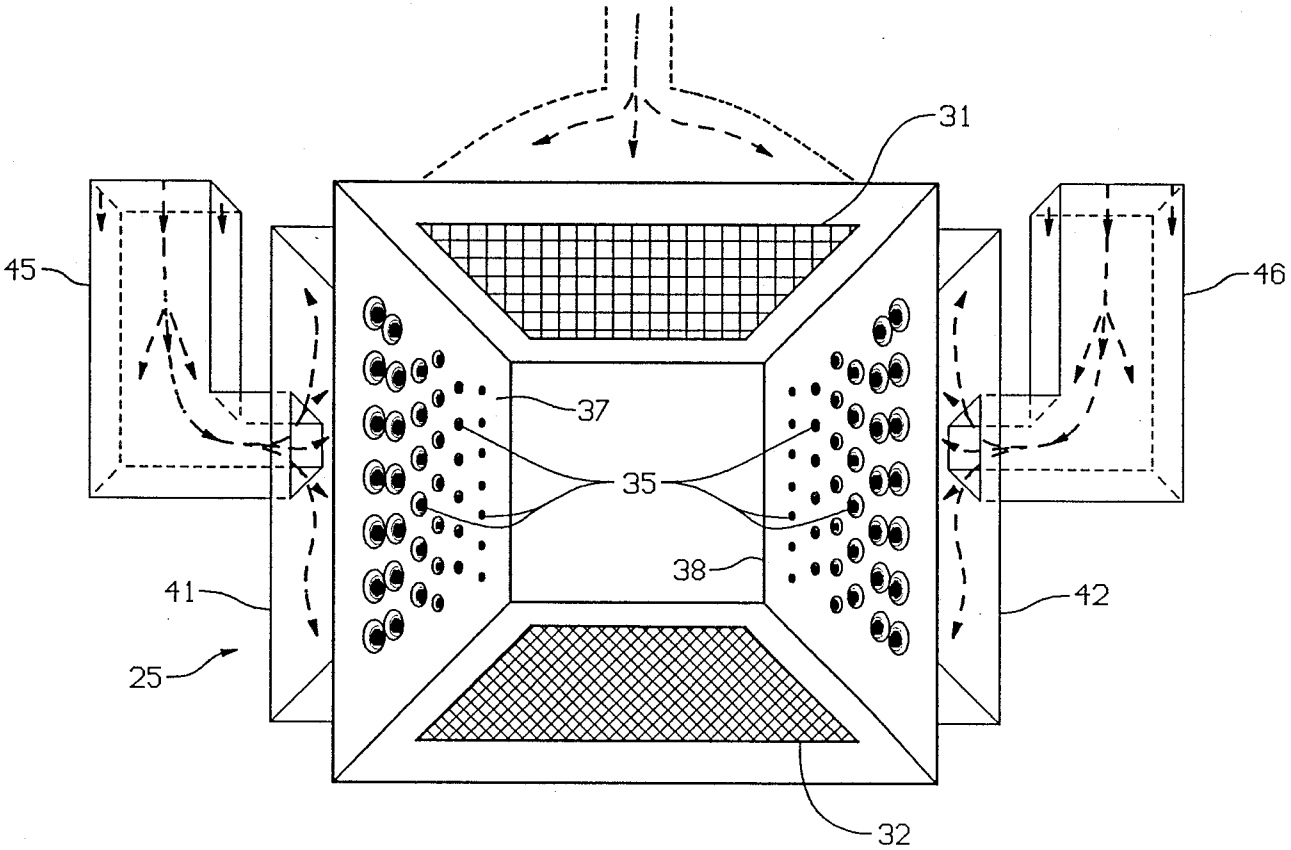
FIG. 2 shows an array of gaspers used with the present invention.

FIG. 2 depicts the configuration for an air shower. The air shower is essentially a tunnel through which the person walks, while directed air drafts are used to blow dust particles off of the user's outer garments.

The air shower 25, like the remainder of the cleanroom facility, has top air vents 31, which are located on the ceiling, and return air vents 32, which appear as air grates on the floor (which is conductive). The top air vents 31 are HEPA filters and admit filtered air. This filtered air flows downward through the return air 32 in the manner previously described.

The return air vents 32 also receive air which is admitted through a matrix of gasper nozzles 35 which are positioned along conductive side walls 37, 38 of the air shower 25. The gaspers 35 are open air nozzles mounted onto ball sockets. The gaspers 35 are similar in appearance and function to gaspers found in aircraft cabins and are similar in structure to hot tub nozzles. Our gaspers 35 have individual shut-off valves, but it is possible to use gaspers without individual shut-off valves. The gaspers function as high velocity air nozzles to direct air streams in preferred directions. The velocity of the air nozzles is approximately 10,000 FPM (feet per minute; this velocity converts to about 50 meters/sec).

The gaspers 35 are directionally adjustable in a manner similar to their aircraft and hot tub counterparts. This allows the air shower 25 to be configured so that a maximum amount of free dust particles are washed from the user's body. Because of the general downward flow of air, it is easy to evacuate the dust particles that are washed off by the gaspers 35, so that the dust particles are evacuated through the return air vents 32.

The air showers provide high air velocity air with vertical laminar flow. A descending density, along the length of the air shower, of the gaspers 35 results in increased particle removal with a minimum of generation of new particles. As the density of the gaspers decreases, the ability of the air showers to provide a downward laminar flow increases. In this manner, the initial high density of gaspers 35 is used to dislodge a maximum quantity of particles from the user, while the lower density of gaspers permits the dislodged particles to be more readily discharged through the return air 32.

The descending density of gaspers 35 also increases user comfort, because the maximum air flow only occurs near the entrance of the air shower. It is believed that the maximum airflow at the entrance of an air shower configured in the described manner controls the air shower's cleaning ability. A given high velocity of air limited to a short distance along the air shower may be more tolerable than a lower velocity of air along the whole length of the air shower (for those users who find the air shower least relaxing), so that the maximum air velocity is able to be increased accordingly. This increased air velocity, combined with a general increased effectiveness of this configuration, results in a more effective air shower that is pleasant to use.

The gaspers 35 can be adjusted by determining a desired direction of air flow and by trial and error methods, using visible representations of contaminants. Typical visible representations include non-ionic surfactant bubbles (low salt kid's bubbles), washed bird feathers, or standard dirt. A variety of visible contaminants would be effective. By directing the nozzles sideways across the user's body and in some cases even upwards, particles can be removed, then drawn out through the return air vents 32.

Referring to FIG. 2, the gaspers 35 are supplied with filtered air by means of manifolds 41, 42, which are in turn supplied by ducts 45, 46. The manifolds and ducts are not normally visible portions of the air shower 25 when a person is walking through the air shower 25. Air supplied through the gaspers 35 is exhausted through the return air 32, so that air supplied to the ceiling air ducts 31 is combined with the air from the gaspers 35 in a common exhaust at the return air 32. A substantial amount of that air is recycled, as is conventional with cleanroom facilities, although this air is filtered prior to being readmitted to the air shower 25.

The ceiling vents 31 and return air vents 32 are typical of those found in entire cleanroom facility, although the percentage of floor and ceiling space used by the vents and return air is reduced in the main part of the cleanroom 49.

The downward flow of air from the ceiling vents 31 to the return air 32 also provides air curtains at the entrances and exits to the air shower 25 and other parts of the cleanroom facility. The air curtains are represented on FIG. 1 by dotted lines 51–59, although this is not all-inclusive. The air curtains 51–59 consist of an alignment of air supply and exhaust so that air on either side of the air curtain does not readily pass across the air space defined by the air curtain. The air curtains are not generally visible boundaries, and may be formed incidentally to the establishment of laminar air flow patterns.

By the use of air curtains, the necessity of providing positive air pressure between different parts of the cleanroom is reduced. At boundaries where a pressure differential is caused to exist, sufficient air supply is provided that the loss of air through the boundary is insufficient to break the air curtain. The use of doorways 61–69 reduces such cross ventilation.

The air curtains (52–58) therefore cover the passageways into and out of the air showers 25, 73. The air within the air showers 25, 73, exhibits a general downward flow, but the gaspers 35 create turbulence because their purpose is to dislodge particulates. The air curtain acts as a barrier to prevent such dislodged particulates from escaping into the surrounding environment. The filtration in the air showers will also serve to trap the dislodged particulates.

After the user leaves the first air shower 25, she passes an entrance to a gown room 23 where the remaining outer garments, including a smock and head gear and gloves, are put on. A second air shower 73 is located between the gown room 23 and the main part of the cleanroom 49. The second air shower 73 is similar to the first air shower 25, except that the second air shower 73 is located so as to provide an air shower after the user's outer cleanroom garments are put on. This second air shower 73 therefore performs as a secondary air shower, with air shower 25 functioning as a primary air shower.

A third air shower 77 is used to provide access from the gown room 23 to a separate cleanroom facility 79. Air shower 77 also functions as a secondary air shower, but for the separate facility 79. The use of the single primary air shower 25 permits the use of common dressing rooms 13, 23 for people entering the separate cleanroom facilities through the separate air showers. This configuration of two separate secondary air showers 73, 77 also permits either cleanroom facility to be compromised for maintenance purposes, or whatever, without disturbing the entrance from the dressing rooms 13, 23 to the other cleanroom facility.

When the user is ready to leave the cleanroom, she enters the gown room 23 through a cleanroom exit door 66, dresses down, exits the gown room 23 through exit passage 68 and enters the bootie room 13.

Figure 3:
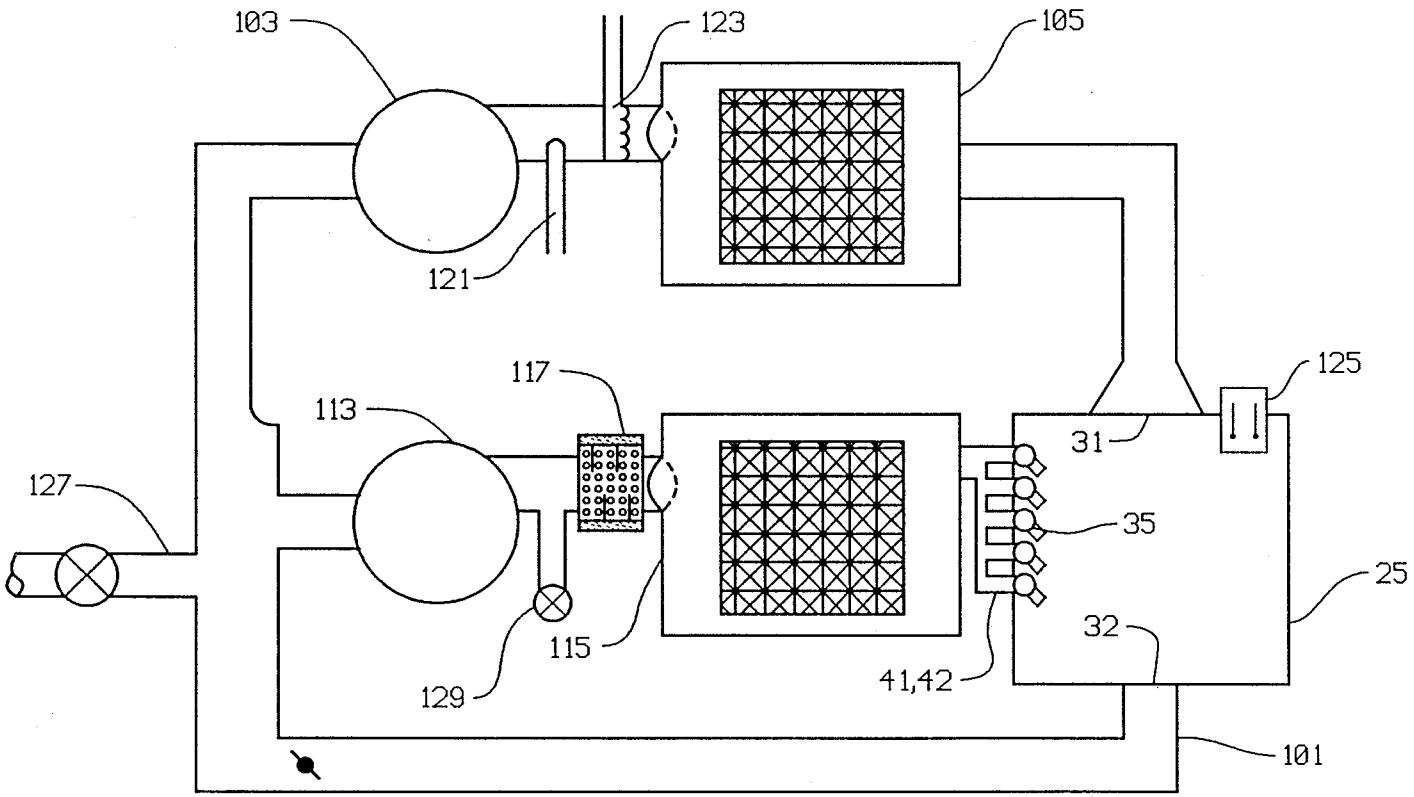
FIG. 3 is a schematic block diagram showing the air handling equipment for providing fresh air to the air shower.

FIG. 3 schematically shows representation of the air showers, such as air shower 25. The return air vents 32 exhaust through a return air manifold 101. A first blower 103 directs air through a first high efficiency air particulate (HEPA) filter 105 at the ceiling vents 31. This blower 103 withdraws air from the return air manifold 101. In practice HEPA filter 105 is located at the ceiling vents 31, so that the HEPA filter 105 and the ceiling vents 31 are not separate units.

A second blower 113, also connected to the exhaust air manifold 101, directs air to a second HEPA filter 115 which directs air to the gasper manifolds 41, 42. The gasper manifolds 41, 42 are shown as individual ducts connected to individual gaspers 35 for clarity, although the actual preferred configuration is of a hollow chamber on each side of the air shower 25.

Sound attenuator 117 is located between the blower 113, and its HEPA filters 115. The attenuator 117 decreases the noise generated by the blower 113, and thereby increase user comfort in the air shower.

A humidifier 121, cooling coils 123 and a deionizer 125 are used to provide climate control. A fresh air intake 127 is used to control the percentage of recycled air. The fresh air intake 127 is also necessary because the cleanroom facilities are provided with a slight positive pressure in order that persons entering the cleanroom do not admit significant amounts of unfiltered air. An exhaust valve 129 functions in a manner similar to an aircraft dump valve to control pressure.

In the preferred embodiment, separate air handling systems are provided for each of the bootie room 13, the gown room 23, the first air shower 25 and the second air shower 73. These air handling systems are separate from the air handling systems for the cleanroom 49. The different air handling systems are balanced in order that a positive air pressure exists to cause air to evacuate out quickly from the cleanroom 49 through the gown room 23 and from the gown room 23 to the bootie room 13 and from the bootie room 13 to the outside environment.

What has been described is a very specific configuration of the invention, as applied to a particular cleanroom facility. Clearly, variations can be made to the original design for adapting the invention to other cleanroom facilities. Likewise, the air shower can be used for other types of dust removal, including removal of excess dust particles from clothing of workers in dusty work environments. The inventive air shower configuration can also be used as a portable facility. Therefore, the invention should be read as limited only by the appended claims.

I claim:

1. Air shower facility having top, bottom, and side walls, and having an entrance and exit, wherein air is caused to flow past a person passing from the entrance to the exit in the air shower in order to cause particles to be removed from the exposed surfaces of the user and the user's garments, characterized by;

(a) floor, ceiling, side walls, entrance and exit defining the inside of the air shower;

(b) the ceiling including a ceiling ventilator;

(c) a floor grate;

(d) an exhaust conduit connected to the floor grate for exhausting air supplied to the inside of the shower;

(e) a matrix of air nozzles mounted to the side walls of the air shower so as to direct air from the air nozzles to the inside of the air shower, the matrix of air nozzles being arranged on two side walls such that the air nozzles provide and direct turbulent flow of air across a person passing through the air shower facility;

(f) the air nozzles being gasper jets;

(g) the air nozzles being arranged in a descending density, along the length of the air shower, so that, as the density of the gaspers decreases, the ability of the air showers to provide a downward laminar flow increases, and an initial high density of air nozzles is used to more readily dislodge particles from a person passing through the air shower, while a lower density of gaspers permits the dislodged particles to be more readily discharged through the floor grate;

(h) a supply manifold connected to the air nozzles;

(i) an air duct to supply air to the manifold;

(j) pump means for supplying air to the ceiling vents and the series of nozzles;

(k) a filter for filtering air supplied by the pump means prior to the air reaching the ceiling vents and the array of nozzles; and (l) the air exhaust manifold exhausting air supplied to the inside of the air shower through the ceiling vents and through the array of nozzles.

2. The air shower facility described in claim 1, further characterized by:

the air nozzles being combined with a downward air flow and with air curtains which limit the escape of dust particles from the air shower.

3. The air shower facility described in claim 2, further characterized by:

primary and secondary air showers being provided, wherein the primary air shower is provided for persons prior to dressing into complete cleanroom garb, and the primary air shower is separated from the secondary air shower by a dressing room.

4. The air shower facility described in claim 3, further characterized by:

the primary and secondary air showers being used to provide particulate contamination reduction for a cleanroom facility;

a third air shower provided as a separate secondary air shower for a second cleanroom facility area, wherein the first air shower is used for both cleanroom facilities, and a common dressing room is used, but the final air showers are separate.

5. The air shower facility described in claim 2, further characterized by:

primary and secondary air showers being provided, wherein the primary air shower is provided for persons prior to dressing into complete cleanroom garb, and the primary air shower is separated from the secondary air shower by a dressing room.

6. The air shower facility described in claim 5, further characterized by:

the primary and secondary air showers being used to provide particulate contamination reduction for a cleanroom facility;

a third air shower provided as a separate secondary air shower for a second cleanroom facility area, wherein the first air shower is used for both cleanroom facilities, and a common dressing room is used, but the final air showers are separate.

7. The air shower facility described in claim 1, further characterized by:

the air nozzles being directionally adjustable so as to allow the air shower to be configured so that a maximum amount of free dust particles are washed from the user's body.

8. The air shower facility described in claim 7 further characterized by:

the ceiling ventilator supplying air to the air shower in a manner so as to provide a general downward flow of air from the ceiling ventilator to the floor grate, the general downward flow of air causing an evacuation of particulates that are washed off by the air nozzles.

9. The air shower facility described in claim 1, further characterized by:

the air nozzles being directionally and volume adjustable so as to allow the air shower to be configured so that a maximum amount of free dust particles are washed from the user's body.

10. The air shower facility described in claim 1, further characterized by:

the downward flow of air from the ceiling vents to the floor grates being used to provide air curtains at the entrance and exit to the air shower, sufficient air supply being provided by the ceiling vent and air nozzles that the loss of air through the entrance and exit is insufficient to break the air curtain.

11. The air shower facility described in claim 1, further characterized by:

a first blower supplying air withdrawn from the exhaust conduit and supplying the air to the ceiling vent and directing air through a first high efficiency air particulate (HEPA) filter to a ceiling vent manifold;

a second blower, also connected to the exhaust conduct and directing air to a second HEPA filter and directing air to the air nozzles.

* * * * *